United States Patent [19]

Maleyko et al.

[11] Patent Number: 4,586,271

[45] Date of Patent: May 6, 1986

[54] EXTENDIBLE BOOT

[76] Inventors: John R. K. Maleyko, 609 Belle River Rd., Belle River, Ontario, Canada, N0R 1A0; Gerald Grijak, 4721 Pickwick Dr., Sterling Heights, Mich. 48077

[21] Appl. No.: 639,501

[22] Filed: Aug. 10, 1984

[51] Int. Cl.[3] ..... A43B 3/00

[52] U.S. Cl. ..... 36/1.5; 36/2 R; 36/7.1 R

[58] Field of Search ..... 36/1.5, 2 R, 7.1 R; 2/232, 69.5, 69, 94, 269, 209.1

[56] References Cited

U.S. PATENT DOCUMENTS

| | | | |
|---|---|---|---|
| 1,090,223 | 3/1914 | McNeer | 36/1.5 |
| 1,632,570 | 6/1927 | Tweedie | 36/2 R |
| 1,901,492 | 3/1933 | Berry | 36/2 R |
| 2,230,291 | 2/1941 | Evans | 36/1.5 |
| 2,824,390 | 2/1958 | Walker | 2/269 |
| 2,857,688 | 10/1958 | Haase | 36/1.5 |
| 3,618,232 | 3/1970 | Shnuriwsky | 36/1.5 |
| 3,744,158 | 7/1973 | Walker | 36/1.5 |
| 4,064,641 | 12/1977 | Levine | 36/1.5 |
| 4,083,124 | 3/1978 | Michalak | 36/7.1 R |
| 4,149,275 | 3/1979 | Sanchez | 2/232 |
| 4,214,318 | 7/1980 | Gomez | 2/209.1 |

OTHER PUBLICATIONS

Gershman "Journal of American Medical Association *Self-Adhering Nylon Tapes,* 10/1958 p. 480.

*Primary Examiner*—Werner H. Schroeder
*Assistant Examiner*—Mary A. Ellis
*Attorney, Agent, or Firm*—Reising, Ethington, Barnard, Perry & Milton

[57] ABSTRACT

An extendible boot is provided with an upper having a base portion and an extendible portion. The extendible portion comprises a flexible sleeve joined to the base portion by a peripherally extending joint. The sleeve is rollable from its upper end to form an annular roll at the joint to provide an unextended boot. The sleeve is unrollable from the annular roll to a higher position and thereby provides an extended boot. A cuff has a fixed end connected with one of the portions in the vicinity of the joint and is adapted to be folded over the annular roll. A hook and loop fastener or a snap fastener is provided to hold the cuff in its folded position to retain and conceal the annular roll of the sleeve.

8 Claims, 6 Drawing Figures

EXTENDIBLE BOOT

FIELD OF THE INVENTION

This invention relates to footwear and more particularly, it relates to a boot which may be worn as a low boot or a high boot.

BACKGROUND OF THE INVENTION

There is a need for a boot, especially of the water resistant type, which can be worn as a low boot or a high boot depending upon the needs of the person wearing the boots. The term "low boot" and the term "high boot" are used herein in a relative sense; in other words, the high boot has an upper which is higher than that of a low boot. The terms are not intended to differentiate one boot style from another except on the basis of height.

There is a problem of providing boots, especially for children, which will afford an adequate, but not excessive, degree of protection from the elements under various conditions. Keeping a person's feet dry in inclement weather is an important concern of all persons; it is a parental concern of paramount importance for young children. Often, a single pair of boots must suffice for a school child who needs a warm and water resistant low boot for wet and cold weather and for shallow snow on the ground and also who needs a high boot for deep snow. Even if a person has a pair of low boots and a pair of high boots, there are circumstances where the needs change but it is not convenient or possible to change boots. A low boot is not satisfactory in deep snow because the snow will enter the top of the boot and will be melted by the body heat and eventually the leg and foot will be wet. A high boot is undesirable when conditions do not require it for protection since it may be less comfortable and also less desirable from an appearance standpoint.

There is a need for a convertible or extendible boot which affords not only satisfactory protection against wet feet but also is comfortable to wear and is attractive in appearance as both a low boot and a high boot. This need has not been satisfied by the prior art.

The Shnuriwsky U.S. Pat. No. 3,618,232 granted Nov. 9, 1971 discloses a boot of the mukluk type, such as a snowmobile boot, with a relatively stiff upper and a flexible tubular sleeve secured about the mouth or opening in the upper. The sleeve is movable from a retracted position embracing the top of the boot to an extended position above the boot. A drawstring is provided at the end of the sleeve to permit it to be tightened around the leg of the wearer.

The Berry U.S. Pat. No. 1,901,492 granted Mar. 14, 1933 discloses a rubber shoe with a legging made of thin stretchable material such as rubber secured to the upper portion. The legging carries an elastic band at the top and may be rolled from a position above the knee to a position at the ankle.

The McNeer U.S. Pat. No. 1,090,223 granted Mar. 17, 1914 discloses a boot with a detachable legging. The legging is provided with a drawstring at its upper end to hold it on the wearer's leg. It has a coil spring around the bottom end which fits into an annular groove in the top of the boot.

The Levine U.S. Pat. No. 4,064,641 granted Dec. 27, 1977 discloses a boot with a legging attached by a zipper; a cuff is provided on the top of the boot to conceal the zipper when the legging is removed.

A general object of this invention is to provide a boot which is convertible from a low boot to a high boot and which overcomes certain disadvantages of the prior art in respect to the cost of manufacture, convenience in use and the degree of protection, comfort and appearance.

SUMMARY OF THE INVENTION

In accordance with this invention, an extendible boot is provided which provides a high degree of water resistance and which may be adjusted in height over a wide range. The boot is of simple construction and easy to adjust to the desired height. It is comfortable to wear and readily adaptable to legs of different size. The boot presents a finished and attractive appearance when it is unextended as well as in its extended position. This is accomplished by a flexible, sleeve-like upper portion which may be rolled down to an unextended position and concealed by a cuff or rolled up to an extended position and held at the mouth in tight engagement with the leg of the wearer to exclude the entry of snow and water.

Further, in accordance with this invention, an extendible boot is provided with an upper comprising a base portion and an extendible portion in the form of a flexible sleeve joined to the base portion by a peripherally extending joint and being open at its upper end. The sleeve is rollable from its upper end to form an annular roll at the joint and thereby provide an unextended boot. The sleeve is also unrollable from the annular roll to a higher position to thereby provide an extended boot. A cuff has a fixed end connected with one of the portions of the upper in the vicinity of the joint and is adapted to be folded over the annular roll. Fastening means includes at least one fastener comprising first and second complementary parts which are adapted to be coupled to and uncoupled from each other. The first part is mounted on one of the portions of the upper and the second part is mounted on the cuff. The annular roll may be retained and concealed by folding the cuff over it and coupling the parts of the fastener to each other.

Further, in accordance with this invention, the cuff comprises an extension of the base portion. Further, the fastening means includes a first fastener on one side of the upper and a second fastener on the other side of the upper. The first fastener may be a snap fastener and the second fastener may be a hook and loop fastener. Further, the base portion and the extendible portion may be of different material. In one embodiment, the base portion and extendible portion may be of woven fabric and the joint comprises sewn stitches with a water resistant coating thereon. In another embodiment, the base portion may be an elastomeric material and the extendible portion may be a fabric with an adhesive joint therebetween. Further, the extendible portion may be provided with a hook and loop fastener at the top thereof for holding the sleeve in tight relationship around the leg of the wearer.

A more complete understanding of this invention may be obtained from the detailed description that follows taken with the accompanying drawings.

BEST MODE FOR CARRYING OUT THE INVENTION

Figure 1:
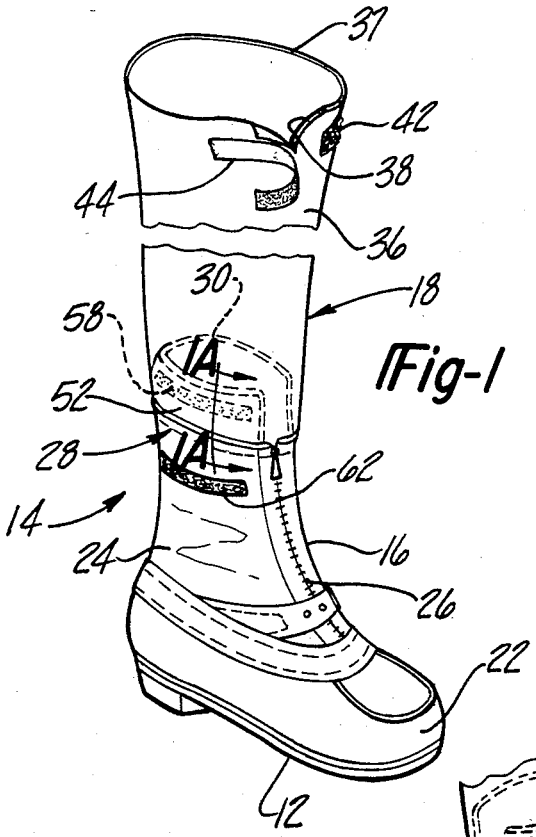
FIG. 1 shows an extendible boot of the snowmobile type according to this invention with the boot in the extended position.

Referring now to the drawings, there is shown an illustrative embodiment of the invention in a snowmobile boot and in a rubber rainwear pull-on boot. It will be appreciated as the description proceeds, that the invention may be utilized in various embodiments with different types of boots.

A snowmobile boot incorporating this invention is shown in FIGS. 1, 1A, 2, 3 and 4. The extendible boot of this invention comprises a sole 12 and an adjoined upper 14. The upper 14 comprises a base portion 16 and an extendible portion 18. The base portion 16 is of conventional structure; it comprises a rubber or plastic riser 22 adjacent the sole 12. An ankle section 24 is constructed of a water resistant fabric. The base portion 16 is provided with a zipper fastener 26.

The extendible portion 18 is a flexible sleeve 36 constructed of a water resistant fabric, such as treated nylon. The upper portion 18 is secured to the base portion 16 by a peripherally extending joint 28. The joint 28 comprises sewn stitches 32 and a water resistant coating 34. Although the coating 34 may be of any suitable type, a preferred coating is sold under the name "Plastiseam" by the Plastic Dip Company of St. Paul, Minn. The sleeve 36 of the extendible portion 18 is preferably a seamless sleeve and it has an opening at its upper end 37 for entry of the wearer's foot.

In order that the upper end 37 of the sleeve 36 of the extendible portion 18 may be drawn tightly around the leg of the wearer, it is provided with an adjustable fastening means. The fastening means comprises a hook and loop type fastener commonly sold under the trademark "VELCRO". The sleeve 36 has an opening or slot 38 extending from the upper end thereof to permit a band of the sleeve to be drawn to a smaller circumference and held in position by the fastening means. A strip 42 of hook material is mounted near the slot 38 on the outside of the sleeve 36. A complementary strip 44 of loop material is mounted on the opposite side of the slot 38 on the inside of the sleeve 36. This arrangement permits the strips 42 and 44 to be positioned in face-to-face opposition when the sleeve 36 is drawn tightly around the user's leg so that the strips may be joined to hold the sleeve 36 in position.

The ankle section of the base portion 16 terminates in an open free end or mouth 30. The band which extends above the joint 28 to the mouth 30 is referred to herein as a cuff 52. The cuff 52 is sufficiently flexible that it may be folded downwardly in the vicinity of the joint 28 for reasons which will appear presently. Fastening means are provided for retaining the cuff in its folded position. The fastening means comprises a hook and loop fastener on the outside of the boot and a pair of snap fasteners on the inside of the boot. The hook and loop fastener includes a strip 58 of hook material on the outside of the cuff 52 and a strip 62 of loop material on the outside of the ankle section 24 below the joint 28. On the inside of the boot, fastening means comprises a pair of snap fasteners spaced circumferentially of each other. One snap fastener includes a male snap member 68 on the outside of the cuff 52 and a complementary female snap member 72 on the ankle section 24 below the joint 28. Similarly, the other snap fastener comprises a male snap member 74 on the outside of the cuff 52 and a complementary female snap member 76 on the ankle section 24.

Figure 2:
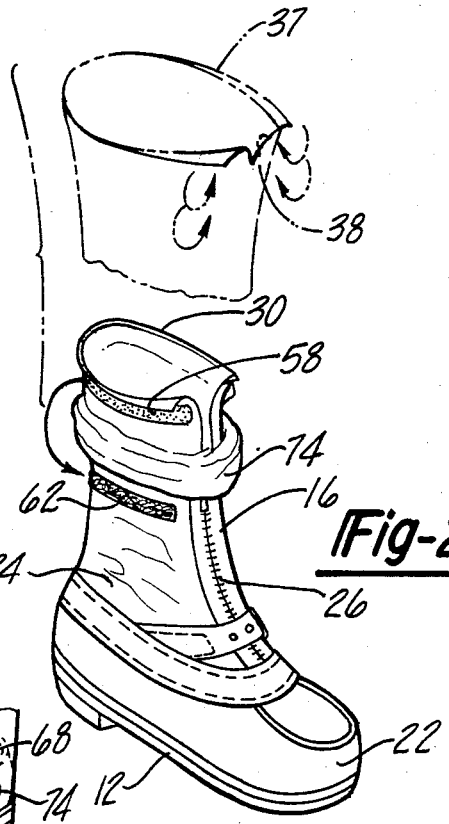
FIG. 2 shows the boot of FIG. 1 in the unextended position with the sleeve rolled down and the cuff open.
Figure 4:
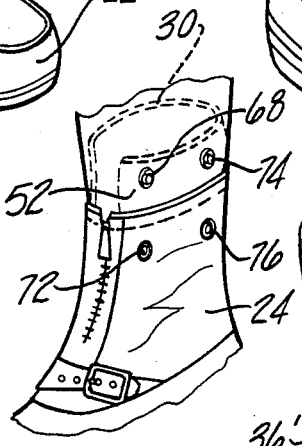
FIG. 4 shows another view of the boot of FIG. 1.
Figure 3:
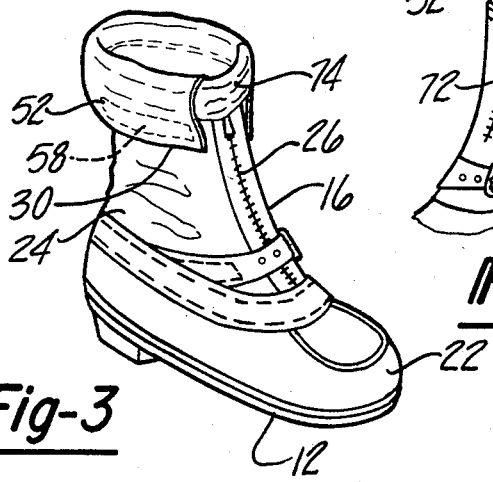
FIG. 3 shows the boot of FIG. 1 in the unextended position with the cuff turned down and fastened.

The boot is depicted in FIG. 1 in its extended position, i.e. the sleeve 36 of extendible portion 18 is extended to its full height. The boot may be made with the full height adapted to reach over the calf, above the knee or even to the groin. The boot is shown with the sleeve 36 unfastened but it will be understood that the upper end thereof may be placed at any desired height on the wearer's leg and tightened and held by coupling the fastening strips 42 and 44. As shown in FIG. 2, if it is desired to place the boot in its unextended position, the sleeve 36 of the extendible portion 18 is rolled down from the top into an annular roll 74 at the joint 28. In this intermediate condition, the cuff 52 may be turned down over the annular roll 74. The cuff 52 is held in this position by coupling the hook strip 58 with the loop strip 62 and by coupling the snap members 68 and 72 and the snap members 74 and 76. It will be appreciated that a hook and loop fastener may be substituted for the snap fastening means or vice versa. Either one of the fastening means will suffice to hold the cuff in its turned down position and thus retain the annular roll 74 and conceal it from view to provide a finished appearance to the boot in its unextended position. The combination of the hook and loop fastener 54 and the snap fastening means 56 is provided to give the user a choice which may be advantageous especially for small children. FIG. 3 shows the boot in its unextended position with the cuff 52 folded down and fastened to retain and conceal the annular roll 74 of the sleeve 36.

Figure 5:
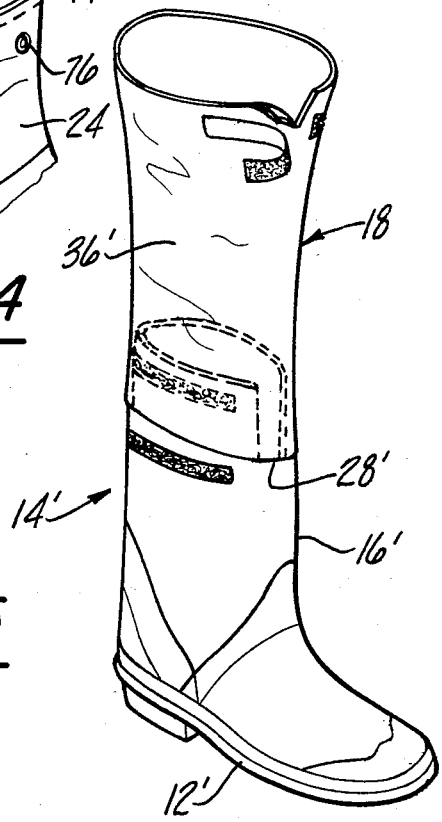
FIG. 5 shows a rubber rainwear pull-on boot according to this invention, in the extended position.
Figure 1A:
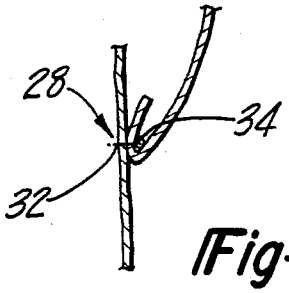
FIG. 1A shows a detail of construction for the boot of FIG. 1.

Another embodiment of this invention is shown in FIG. 5. In this embodiment, the invention is incorporated in a rubber or elastomeric rainwear pull-on boot. The extendible boot, as shown in FIG. 5, comprises a sole 12′ and an upper 14′, the upper including a base portion 16′ and an extendible portion 18′. The base portion 16′ and the sole 12′, as in a conventional pull-on boot, are constructed of a unitary molded body of elastomeric material. The extendible portion 18′ is a flexible sleeve 36′ suitably constructed of a waterproof or water resistant fabric such as treated nylon. The sleeve 36′ is secured to the base portion 16′ by a peripherally extending joint 28′. The joint 28′ comprises a water resistant adhesive which joins the lower end of the sleeve 36′ to the base section 16′. Except for the foregoing description, the extendible boot of FIG. 5 is of the same construction as that described with reference to FIGS. 1 through 4 and it is used in the same manner.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. An extendible boot comprising, a base portion and an extendible portion, said extendible portion comprising a flexible sleeve joined to said base portion by a peripherally extending joint and being open at its upper end, said sleeve being rollable from its upper end to form an annular roll at said joint and thereby provide an unextended boot, said sleeve being unrollable from said annular roll to a higher position than the position of said joint and thereby provide an extended boot, a cuff having a fixed end connected with one of said portions in the vicinity of said joint and having an open free end and a foldable part between said ends adapted to be folded over said annular roll, fastening means including at least one fastener comprising first and second complementary parts adapted to be coupled to and uncoupled from each other, said first complementary part being mounted on one of said portions, and said second complementary part being mounted on said cuff, whereby said annular roll may be retained and concealed by folding said cuff and coupling said parts of said fastener to each other.

2. The invention as defined in claim 1 wherein said cuff comprises an extension of said base portion.

3. The invention as defined in claim 1 wherein said base portion and said extension portion are constructed of different materials and both are water resistant.

4. The invention as defined in claim 1 wherein said fastening means includes a first fastener on one side of said upper and a second fastener on the other side of said upper.

5. The invention as defined in claim 4 wherein said first fastener is a snap fastener and the second said fastener is a hook and loop fastener.

6. The invention as defined in claim 1 wherein said base portion and said extension portion are both constructed of a woven fabric, and said joint comprises sewn stitches with a water resistant coating thereon.

7. The invention as defined in claim 1 wherein said base portion is constructed of an elastomeric material and said extension portion is constructed of a woven fabric, and said joint comprises a water resistant adhesive.

8. The invention as defined in claim 1 including a hook and loop fastener having a hook part and a loop part, said parts being secured to said extendible portion near the upper end in opposed relation for holding said sleeve in tightened relation around the wearer's leg.

* * * * *